US010347454B2

(12) United States Patent
Lehmann

(10) Patent No.: US 10,347,454 B2
(45) Date of Patent: Jul. 9, 2019

(54) OVERLOAD RELEASE

(71) Applicant: Siemens Aktiengesellschaft, Munich (DE)

(72) Inventor: Stephan Lehmann, Hahnbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/463,178

(22) Filed: Mar. 20, 2017

(65) Prior Publication Data

US 2017/0345599 A1 Nov. 30, 2017

(30) Foreign Application Priority Data

May 24, 2016 (DE) ..... 10 2016 208 930

(51) Int. Cl.

| | |
|---|---|
| ***H01H 71/16*** | (2006.01) |
| ***H01H 9/20*** | (2006.01) |
| ***H01H 71/50*** | (2006.01) |
| ***H01H 73/50*** | (2006.01) |

(52) U.S. Cl.

CPC ..... *H01H 71/16* (2013.01); *H01H 9/20* (2013.01); *H01H 71/505* (2013.01); *H01H 73/50* (2013.01)

(58) Field of Classification Search

CPC ..... H01H 71/16; H01H 9/20; H01H 71/505; H01H 73/50

USPC ..... 337/36

See application file for complete search history.

(56) References Cited

U.S. PATENT DOCUMENTS

| | | | | |
|---|---|---|---|---|
| 3,947,791 | A | 3/1976 | Hennemann | |
| 4,622,530 | A | 11/1986 | Ciarcia et al. | |
| 5,059,933 | A | 10/1991 | Castonguay et al. | |
| 6,181,226 | B1 * | 1/2001 | Leone | H01H 71/2454 335/132 |
| 6,255,925 | B1 * | 7/2001 | DiMarco | H01H 71/7463 335/176 |
| 7,839,241 | B2 * | 11/2010 | Weber | H01H 71/526 335/35 |
| 2012/0169451 | A1 * | 7/2012 | Mooney | H01H 71/145 337/382 |

(Continued)

FOREIGN PATENT DOCUMENTS

| | | | |
|---|---|---|---|
| CN | 101004987 | A | 7/2007 |
| CN | 103295807 | A | 9/2013 |

(Continued)

OTHER PUBLICATIONS

Extended European Search Report dated Sep. 28, 2017.

*Primary Examiner* — Anatoly Vortman

(74) *Attorney, Agent, or Firm* — Harness, Dickey & Pierce, P.L.C.

(57) ABSTRACT

An overload release includes a bimetallic element, a tripping slide, a latch and an energy store. In an overload situation the bimetallic element actuates the tripping slide; as a result, the tripping slide actuates the latch, and as a result, the latch allows the movement of the energy store. The latch is provided with a latch area and the energy store is provided with a latching area, the two areas mechanically interacting in the latched state and the latch area being released from the latching area in the unlatched state, when there is an overload, to allow the movement of the energy store. Further, the latch area or the latching area includes a projection.

8 Claims, 3 Drawing Sheets

(56) References Cited

U.S. PATENT DOCUMENTS

| | | | | |
|---|---|---|---|---|
| 2013/0228428 | A1 | 9/2013 | Bunk et al. | |
| 2015/0206688 | A1* | 7/2015 | Cantu Gonzalez .... | H01H 71/16 335/35 |
| 2015/0228433 | A1* | 8/2015 | Carrillo Soto ..... | H01H 71/16 335/43 |

FOREIGN PATENT DOCUMENTS

| | | | |
|---|---|---|---|
| DE | 1858351 | U | 9/1962 |
| DE | 3545490 | A1 | 7/1987 |
| DE | 3619242 | A1 | 12/1987 |
| DE | 202016001905 | U1 | 5/2016 |
| EP | 0035693 | A1 | 9/1981 |
| FR | 2258698 | A1 | 8/1975 |
| GB | 686516 | A | 1/1953 |

* cited by examiner

OVERLOAD RELEASE

PRIORITY STATEMENT

The present application hereby claims priority under 35 U.S.C. § 119 to German patent application number DE 102016208930.7 filed May 24, 2016, the entire contents of which are hereby incorporated herein by reference.

FIELD

At least one embodiment of the invention generally relates to an overload release.

BACKGROUND

In molded-case circuit breakers, various bimetallic elements or instantaneous releases in the overload release act on an unlatching point. As a result, the latter is actuated and acts on a breaker latching mechanism, by which the electrical contacts of the molded-case circuit breaker are opened.

There is the requirement that a molded-case circuit breaker must be able to interrupt a circuit in response to multiple short circuits, while it is still possible thereafter for overload trips to take place. The short circuits have the effect that the latching area of an energy store is contaminated to such an extent that undelayed trips are possible.

In such a case of contamination, overload trips are made more difficult by increased friction as a result of the contamination. In the case of conventional molded-case circuit breakers, the release force for unlatching the tripping unit after a short circuit, and consequent heavy contamination, is many times greater than before the short circuit. Contaminants collect in the unlatching region and therefore increase the friction significantly.

This has the effect that, after a short circuit, the thermal unlatching (overload tripping) required to comply with standards becomes uncertain. This problem often occurs in the case of molded-case circuit breakers with high rated currents, for example of 125 A (amperes) or 160 A. With high rated currents, the short-circuit current becomes less well confined than with low rated currents, which leads to a stronger erosion of the contact material and to a greater development of gas (pressure). Molded-case circuit breakers with low rated currents have a higher internal resistance, and consequently confine the short-circuit current better. This is not possible however with high rated currents, since the allowed heating in the customer connection region is stipulated by the standard.

SUMMARY

At least one embodiment of the invention provides an overload release that can continue to trip reliably when there is contamination.

At least one embodiment of the invention is directed to an overload release. Advantageous refinements of the overload release according to embodiments of the invention are specified in the claims.

The overload release according to at least one embodiment of the invention includes a bimetallic element, a release, a tripping slide, a latch and an energy store, an overload having the effect that the bimetallic element actuates the tripping slide;

as a result, the tripping slide actuates the latch, and as a result, the latch allows the movement of the energy store, in which the latch is provided with a latch area and the energy store is provided with a latching area, the two areas mechanically interacting in the latched state and the latch area being released from the latching area in the unlatched state, when there is an overload, to allow the movement of the energy store, the latch area or the latching area having a projection.

The properties, features and advantages of this invention that are described above and also the manner in which they are achieved become clearer and more easily understandable in connection with the following description of the example embodiments, which are explained more specifically in conjunction with the figures.

DETAILED DESCRIPTION OF THE EXAMPLE EMBODIMENTS

Figure 1:
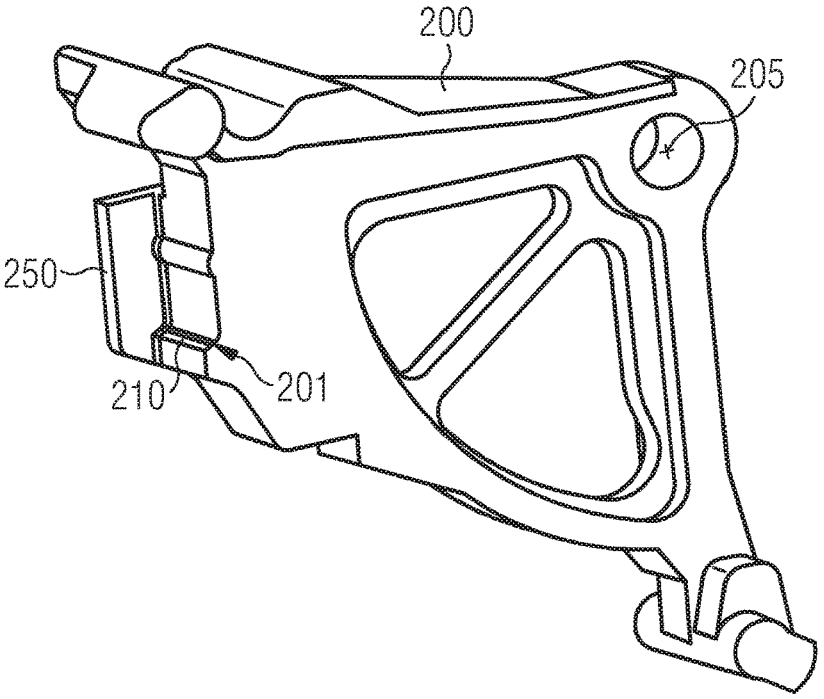
FIG. 1 shows an energy store with a projection.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The overload release according to at least one embodiment of the invention includes a bimetallic element, a release, a tripping slide, a latch and an energy store, an overload having the effect that the bimetallic element actuates the tripping slide;

as a result, the tripping slide actuates the latch, and as a result, the latch allows the movement of the energy store, in which the latch is provided with a latch area and the energy store is provided with a latching area, the two areas mechanically interacting in the latched state and the latch area being released from the latching area in the unlatched state, when there is an overload, to allow the movement of the energy store, the latch area or the latching area having a projection.

It is advantageous here that contamination can be taken up by depressions in the unlatching region that are created alongside the projection. As a result, an increase in friction in the unlatching region is prevented or reduced. Contaminants that are deposited on the projection can be transported away from the projection by the latching process. The fact that the latch area or the latching area has a projection means that the contact area between the latch and the energy store is more strictly defined.

In a refinement, the projection of the latch area or the latching area is formed as a linear projection on the latch area or latching area.

In a further refinement, the linear projection is formed perpendicularly to the direction of movement of the latch or of the energy store.

In a further refinement, the latch and the energy store respectively describe a circular movement around a fixed center point in each case.

In a further refinement, the linear projection is formed parallel to the direction of movement of the latch or of the energy store.

In FIG. 1, an energy store 200 according to an embodiment of the invention is represented. The energy store 200 has a latching area 201. Provided on this latching area 201 is a projection 210. The projection 210 has the effect that contaminants that are deposited on it during a tripping operation can be transported into the depressions to the right and left of the projection 210. As a result, the contact area of the projection 210 of the energy store 200 is not covered with contaminants. Consequently, there is no increase in friction.

Figure 3:
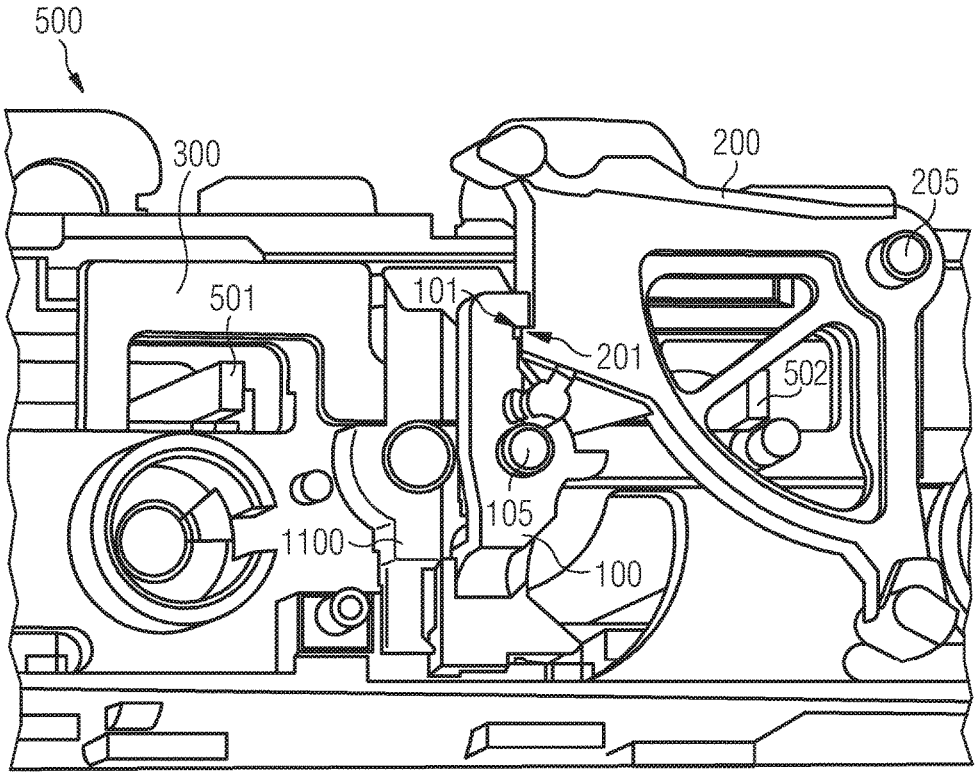
FIG. 3 shows an overload release with an energy store and a latch.

In FIG. 3, the overload release 500 according to an embodiment of the invention is represented. The overload release 500 comprises an energy store 200, which interacts with a latch 100, the latch 100 being provided with a latch area 101 and the energy store 200 being provided with a latching area 201. In the latched state, these two areas 101; 201 mechanically interact. In the unlatched state, when there is an overload, the latch area 101 is released from the latching area 201 to allow the movement of the energy store 200.

In the case of a short circuit, contaminants are produced inside the switch. As depicted in FIG. 3, this means that contaminants flow out of the overload release 500 in the direction of the energy store 200.

The overload release 500 from FIG. 3 comprises an energy store 200 and a latch 100. The latch 100 interacts with the energy store 200 to release the energy stored in the energy store 200. As depicted in FIG. 3, this means that, for the release, the latch 100 must be turned counterclockwise about its fixed center point 105 and the energy store 200 must be turned clockwise about its fixed center point 205.

In FIG. 3, bimetallic elements 501; 502 are similarly represented. In the case of an overload, these bimetallic elements 501; 502 actuate a tripping slide 300 by bending out to the left as depicted in FIG. 3 in the case of an overload and taking the tripping slide 300 along in this direction.

The tripping slide 300 acts on the latch 100 for example by way of a deflector 1100. As a result, the latch 100 is turned counterclockwise about its fixed center point 105. The linear movement of the tripping slide 300 is converted into a circular movement of the latch 100. The tripping slide 300 actuates the latch 100 directly or indirectly.

The projection 210 represented in FIG. 1 on the latching area 201 of the energy store 200 interacts with the latch area 101 of the latch 100. It is advantageous in this case that the projection 210 offers a well-defined bearing or contact area, on which no contaminants can be deposited on account of the interaction with the latch 100. If contaminants are nevertheless deposited on the projection 210 in the case of tripping, this contamination is transported away from the projection 210 during latching, for example into the depression alongside the projection 210 on the latching area 201.

Figure 2:
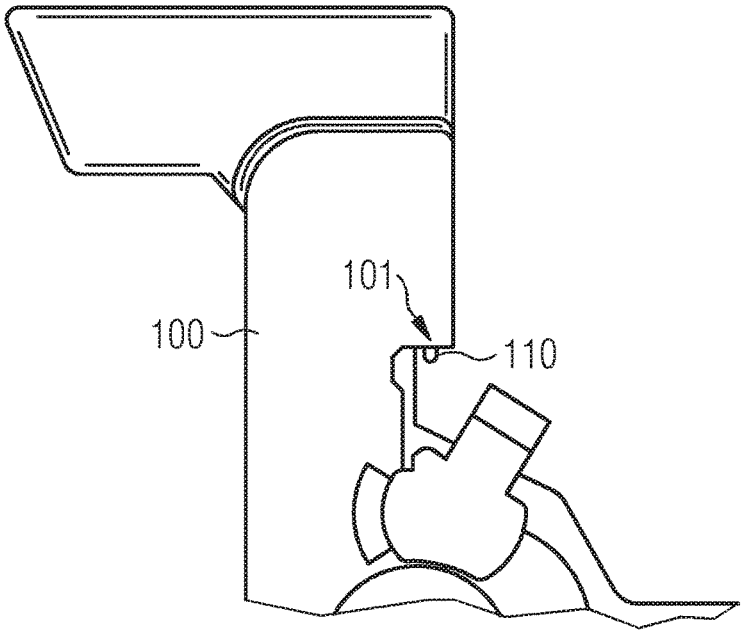
FIG. 2 shows a latch with a projection on the latch area.

According to FIG. 2, in an alternative embodiment a projection 110 is arranged on the latch area 101. This projection 110 also offers the same advantages as the projection 210 of the energy store 200. Although contaminants can accumulate on the projection 110 in the case of tripping, this contamination is transported away from the projection 110 during latching, for example into the depression alongside the projection 110.

The overload release 500 from FIG. 3 with the bimetallic elements 501; 502, the tripping slide 300, the latch 100 and the energy store 200 trips as follows when there is an overload:

The bimetallic element 501; 502 actuates the tripping slide 300; as a result, the tripping slide 300 actuates the latch 100 and, as a result, the latch 100 allows the movement of the energy store 200. For example, the tripping slide 300 can describe a linear movement. The latch 100 and the energy store 200 respectively describe a circular movement about a fixed center point 105; 205 in each case.

Figure 4:
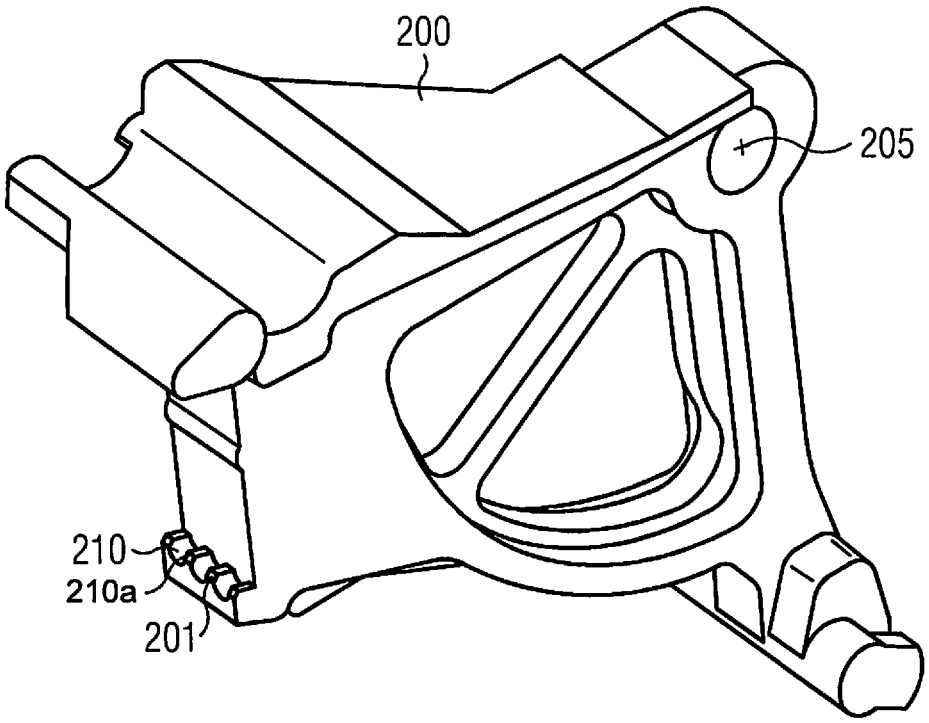
FIG. 4 shows a variant of the projection-like latching area with a projection arranged parallel to the direction of movement of the latch.

In FIG. 4, an energy store 200 according to an embodiment of the invention is represented. The energy store 200 has a latching area 201. A number of projections 210; **210*a* are provided on this latching area 201. The projections 210; 210*a* have the effect that contaminants that are deposited on the projection during a tripping operation can be transported into the depressions to the right and left of the projections 210; 210*a*. As a result, the contact area of the projections 210; 210*a* of the energy store 200** is not covered with contaminants. Consequently, there is no increase in friction.

The linear projections 210; **210*a* are formed perpendicularly to the direction of movement of the latch 100 or of the energy store 200**.

The latching contour, either of the latch 100 or of the energy store 200, has been redesigned to make the latching unsusceptible to contamination and production tolerances. For this, a projection 110; 210 has been created, producing a defined bearing area and having a longitudinal groove or depression that can collect contaminants. As a result, an increase in friction in the unlatching region is prevented or reduced.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An overload release, comprising:

a bimetallic element;

a tripping slide;

a latch including a latch area; and an energy store including a latching area, wherein in response to an overload:

the bimetallic element is configured to actuate the tripping slide;

the tripping slide is configured to actuate the latch, and the latch is configured to allow movement of the energy store, the latch and latching areas being configured to, in response to the overload, mechanically interact in a latched state and the latch area being configured to, in response to the overload, be released from the latching area in an unlatched state, to allow the movement of the energy store, wherein the latch area or the latching area includes a projection.

2. The overload release of claim 1, wherein the projection is formed as a linear projection on the latch area or the latching area.

3. The overload release of claim 2, wherein the linear projection is formed perpendicularly to a direction of movement of the latch or of the energy store.

4. The overload release of claim 1, wherein the latch and the energy store are configured to respectively describe a circular movement around a fixed center point.

5. The overload release of claim 2, wherein the linear projection is formed parallel to the direction of movement of the latch or of the energy store.

6. The overload release of claim 2, wherein the latch and the energy store are configured to respectively describe a circular movement around a fixed center point.

7. The overload release of claim 3, wherein the latch and the energy store are configured to respectively describe a movement around a fixed center point.

8. The overload release of claim 1, wherein the projection has a defined bearing area and a longitudinal groove or depression that can collect contaminants.

* * * * *